US009969526B1

(12) United States Patent
Lowther et al.

(10) Patent No.: US 9,969,526 B1
(45) Date of Patent: May 15, 2018

(54) PALLET WITH RETENTION APPARATUS

(71) Applicant: Amazon Technologies, Inc., Seattle, WA (US)

(72) Inventors: Daniel Lowther, Washington Crossing, PA (US); Sriram Radhakrishnan, Bellevue, WA (US); Lifan Zhang, Seattle, WA (US); Dennis Williams, Winchester, VA (US); Axel Sommer, Winchester, VA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days. days.

(21) Appl. No.: 15/480,217

(22) Filed: Apr. 5, 2017

(51) Int. Cl.
*B65D 19/44* (2006.01)
*B65D 19/00* (2006.01)

(52) U.S. Cl.
CPC ..... *B65D 19/44* (2013.01); *B65D 19/0034* (2013.01); *B65D 2519/00273* (2013.01); *B65D 2519/00288* (2013.01); *B65D 2519/00318* (2013.01); *B65D 2519/00373* (2013.01); *B65D 2519/00815* (2013.01); *B65D 2519/00865* (2013.01)

(58) Field of Classification Search
CPC ..... B65D 19/44; B65D 19/00
USPC ..... 108/55.1, 55.3, 55.5, 51.11
See application file for complete search history.

(56) References Cited

U.S. PATENT DOCUMENTS 1,181,377 A * 5/1916 Dowell ..... B60P 7/0823 224/42.39
2,936,985 A * 5/1960 Doerr ..... B65D 19/08 108/54.1
3,620,388 A * 11/1971 Mansson ..... B65D 88/129 108/53.1
3,753,407 A * 8/1973 Tilseth ..... B65D 19/44 108/53.3
4,309,013 A * 1/1982 Howe ..... B65D 19/12 108/53.1
4,355,732 A * 10/1982 Nessfield ..... B65D 88/129 108/55.3
5,423,428 A * 6/1995 Selz ..... B60P 7/0869 206/386
5,639,174 A * 6/1997 Gonska ..... B65D 88/129 108/55.1
5,676,065 A * 10/1997 Locker ..... B65D 88/005 108/51.11
5,755,472 A * 5/1998 Clive-Smith ..... B65D 88/129 108/53.1
6,216,607 B1 * 4/2001 Cuddy ..... B65D 19/0012 108/55.1
6,821,068 B2 * 11/2004 Facey ..... B60P 7/0838 108/55.1

(Continued)

*Primary Examiner* — Jose V Chen
(74) *Attorney, Agent, or Firm* — Kilpatrick Townsend & Stockton LLP

(57) ABSTRACT

A retention system for a pallet can include retention elements that pivot around pivoting assemblies at one or more edges of the pallet. A retention rail can adopt a stowed position against or within the pallet, can lock in an upright position at a side of the pallet, or an open position extending away from the pallet, providing clear access for loading or unloading in the open position. Further retention features can be combined with the retention rails, including integrated retention straps and strap receiving elements.

20 Claims, 9 Drawing Sheets

(56) References Cited

U.S. PATENT DOCUMENTS

| | | | | |
|---|---|---|---|---|
| 6,866,160 | B2 * | 3/2005 | Wang | B65D 88/123 108/55.1 |
| 6,929,438 | B1 * | 8/2005 | Foster | B60P 7/083 410/100 |
| 7,044,065 | B2 * | 5/2006 | Arai | B65D 19/12 108/53.1 |
| 8,505,469 | B2 * | 8/2013 | Liu | B65D 19/001 108/50.11 |
| 9,540,139 | B2 | 1/2017 | Baltz | |

* cited by examiner

PALLET WITH RETENTION APPARATUS

BACKGROUND

Modern inventory and logistical systems, such as those involving mail-order warehouses, airport luggage systems, custom-order manufacturing facilities, and freight carriers, face significant challenges in logistics and storage for items of varying sizes and weights. In inventory systems tasked with transporting, storing, and moving large items with high throughput, delays in transferring inventory items between carriers and storage facilities can significantly impact efficiencies. Furthermore, in inventory systems that require moving groups of large items, the process of breaking up or recombining groups of items for storage is often labor-intensive and can exacerbate risks of damage or mishandling of items.

Existing inventory and logistical systems employ pallets to carry inventory items, individually or in groups. In some cases, pallets can include features that retain the inventory items. For example, U.S. Pat. No. 9,540,139 discloses a pallet that includes a frame extending upward from a pallet. In general, pallets without built-in features for retaining items provide less secure storage; while pallets with built-in features are more difficult to store and to load or unload. Thus, the inventors have identified a need for pallets that can retain inventory items securely without obstructing the loading or unloading process.

BRIEF DESCRIPTION OF THE DRAWINGS

Various embodiments in accordance with the present disclosure will be described with reference to the drawings, in which.

DETAILED DESCRIPTION

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Figure 1:
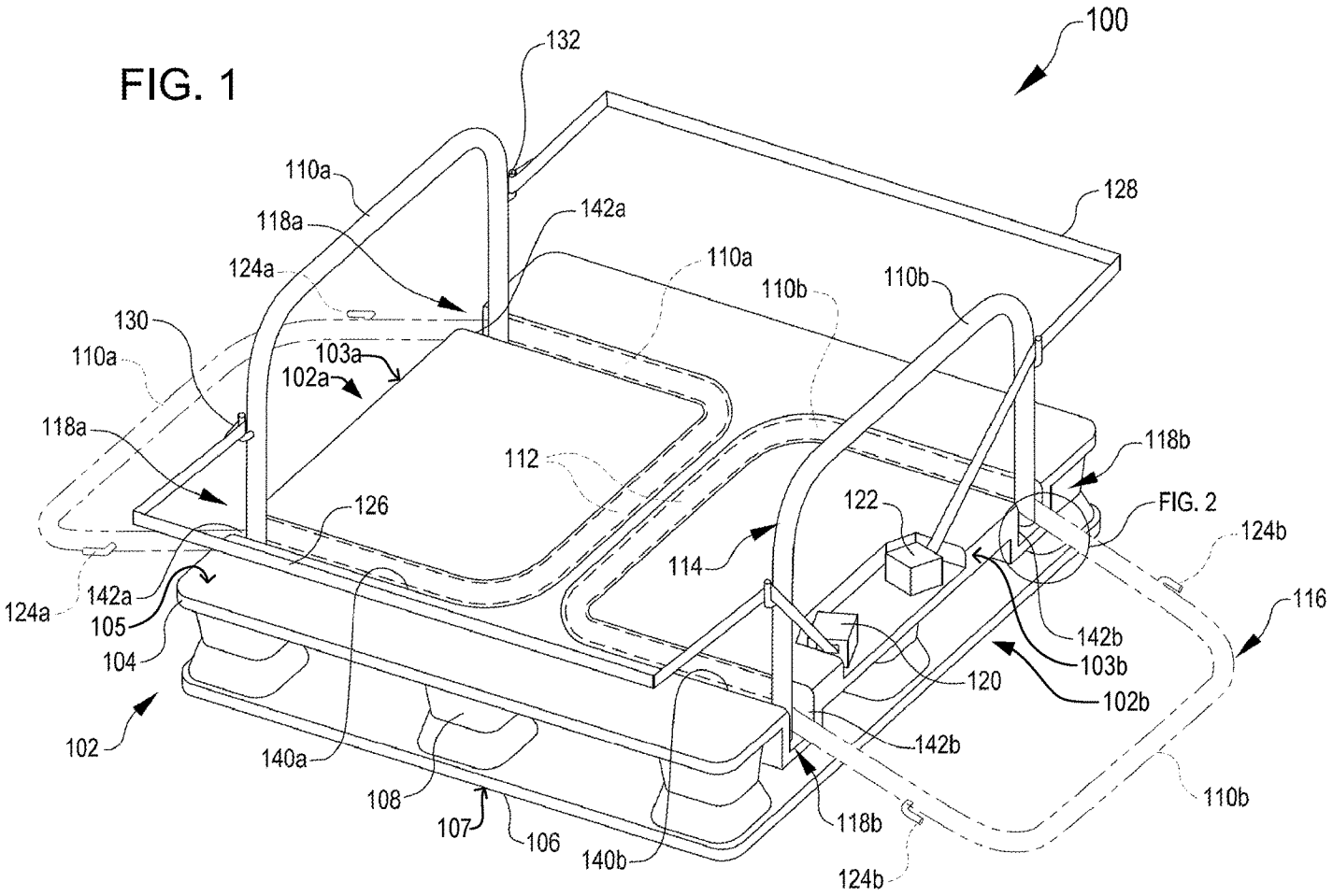
FIG. 1 illustrates components of a pallet with a pivoting retention assembly, in accordance with embodiments.

FIG. 1 shows a pallet 100 with retention features including first and second retention rails 110*a*, 110*b*, (cumulatively 110) in accordance with embodiments. The pallet 100 as shown is a four-way pallet including a pallet body 102 with a upper support structure 104 having a top surface 105, a bottom support structure 106 having a bottom surface 107, and pillars 108 connecting the upper and lower support structures. Although the pallet 100 shown is a sandwich-type pallet, aspects of the embodiments disclosed herein may be applied to other types of pallets without deviating from the scope of this disclosure. The pallet 100 can be formed of any suitably rigid material including, but not limited to: wood, metal, stiff structural polymers, recycled materials, composite materials, any suitable combination of the above materials, or other comparable materials. The pallet 100 can include any suitable structural or weight-reducing internal or external structure, such as corrugated or shaped surfaces, internal supports, surface coatings, or the like. In alternative embodiments, pallets can include two-way pallets or any other comparable platform that operates as a pallet. The pallet 100 can also include voids 140*a*, 140*b* (cumulatively 140) in the upper support structure 104 for receiving the retention rails 110*a*, 110*b*. The voids 140*a*, 140*b* can be sufficiently deep so that the rails 110*a*, 110*b* can rest collapsed in the voids and flush with the upper support structure 104, or in some cases below a level of the upper support structure.

The pallet 100 includes retention features including first and second retention rails 110*a* and 110*b*, in accordance with embodiments. The retention rails 110*a*, 110*b* connect with the pallet body 102 by way of retention assemblies 118*a*, 118*b*, (cumulatively 118) respectively. The retention assemblies 118*a* and 118*b* are located at opposite sides 102*a*, 102*b* of the pallet body 102, respectively, with the first retention assembly 118*a* adjacent the first side 102*a*, and the second retention assembly 118*b* adjacent the second side 102*b*. The first and second sides 102*a*, 102*b* are defined by a front face 103*a* of the pallet body 102, and by a rear face 103*b*. The retention rails 110*a*, 110*b* shown herein are substantially U-shaped members which connect with the retention assemblies 118*a*, 118*b* at two points each along the first and second sides 102*a*, 102*b* of the pallet body 102. In alternative embodiments, the retention rails 110*a*, 110*b* can have other configurations operable to provide support across two sides of a pallet body. For example, alternative retention rails may but substantially T-shaped, connecting at a single point along a side of a pallet body; or alternative retention rails may have more than two connection points to a pallet body. According to some embodiments, the retention assemblies 118*a*, 118*b* are assembled with the pallet body 102 via sets of recesses 142*a*, 142*b* positioned in the first and second sides 102*a*, 102*b* of the pallet body. The sets of recesses 142*a*, 142*b* include sets of openings in the front face 103*a* and rear face 103*b* of the pallet body 102, respectively.

Retention features of the pallet 100 can further include strap receiving elements 124*a*, 124*b* (cumulatively retention elements 124) located on the retention rails 110*a*, 110*b* which provide anchors for looping or anchoring straps or ties to the retention rails and/or to any inventory on the pallet. In some embodiments, two first retention elements 124*a* are provided at opposite ends of the first retention rail 110*a* and two second retention elements 124*b* are provided at opposite ends of the second retention rail 110*b*. However, in alternative embodiments, any suitable number of retention elements can be provided across retention rails. A variety of structures can be used as retention elements. For example, according to some embodiments, retention elements 124*a*, 124*b* can include L-shaped extensions from the retention rails 110*a*, 110*b*. According to some alternative embodiments, retention elements can include notches provided in retention rails through which straps or ties can be threaded, can include rings or brackets attached with retention rails, and can include both closed loop structures, open structures, or open structures that include closing features.

Retention features of the pallet 100 can also include integrated strap source elements 120, 122, in accordance with embodiments. Strap source elements 120, 122 can be attached with or embedded in the pallet body 102, and may include one or more retractable straps 126, 128. The retractable straps 126, 128 can be readily extended from the source elements 120, 122, either singly or in combination, and used in conjunction with strap receiving elements 124*a*, 125*b* to secure items to one or both of the retention rails 110*a*, 110*b*. The retractable straps 126, 128 can be run through the retention elements 124*a*, 124*b* and/or attached to the retention elements by way of end loops 130, 132 or the like. Strapping configurations are shown in more detail with reference to FIGS. 8-9.

Retention features of the pallet 100 can be oriented in stowed, upright, or open (i.e. loading) configurations. For example, the retention rails 110*a*, 110*b* are shown in an upright configuration 114, where the retention rails are secured perpendicular to the upper support structure 104 of the pallet 100 and extending upward from the first and second edges 102*a*, 102*b*. In a stowed configuration 112, the retention rails 110*a*, 110*b* can be folded inward toward the upper support structure 104 of the pallet 100 and secured at or below the upper support structure 104, e.g., in voids 140*a*, 140*b*. This stowed configuration 112 may be used when a pallet is being stored, stacked, or moved together with other pallets, or when the pallet is being used to support inventory that does not require further retention features. In some cases, e.g. where a pallet is to be loaded asymmetrically, one retention rail may be retained in the upright configuration 114 while the other rail is stowed in the stowed configuration 112, so that the stowed rail does not impede loading or unloading of inventory. Alternatively, both retention rails 110*a*, 110*b* can be folded away from the upper support structure 104 of the pallet 100 into an open configuration 116. In the open configuration 116, one or both retention rails 110*a*, 110*b* are positioned more than 90 degrees from the stowed configuration 112, i.e., beyond the upright configuration 114. In some embodiments, the open configuration 116 can be less than 180 degrees from the stowed configuration, such that one or both retention rails 110*a*, 110*b* are expanded apart from one another to provide easier access to cargo on the pallet 100. In some embodiments, and as shown, the open configuration 116 can be more than 180 degrees from the stowed configuration 112, so that one or both of the retention rails 110*a*, 110*b* extend below the top surface 105 of the upper support structure 104. The open configuration 116 allows the pallet 100 to be loaded or unloaded from any side without the retention rails 110*a*, 110*b* obstructing the loading or unloading process. The retention rails 110*a*, 110*b* can then be readily returned from the open configuration 116 to an upright configuration 114 without requiring adjustment of inventory positioned on the pallet 100. One of the retention rails 110*a*, 110*b* can be left in the upright configuration 114 while the other of the retention rails is moved to the open configuration 116 in order to facilitate a loading process that stacks inventory against the upright retention rail. In some alternative embodiments, the open configuration 116 can be defined by the retention rails 110*a*, 110*b* being positioned approximately 180 degrees from the stowed configuration 112. Loading configurations are shown in more detail with reference to FIGS. 8-9.

Figure 2:
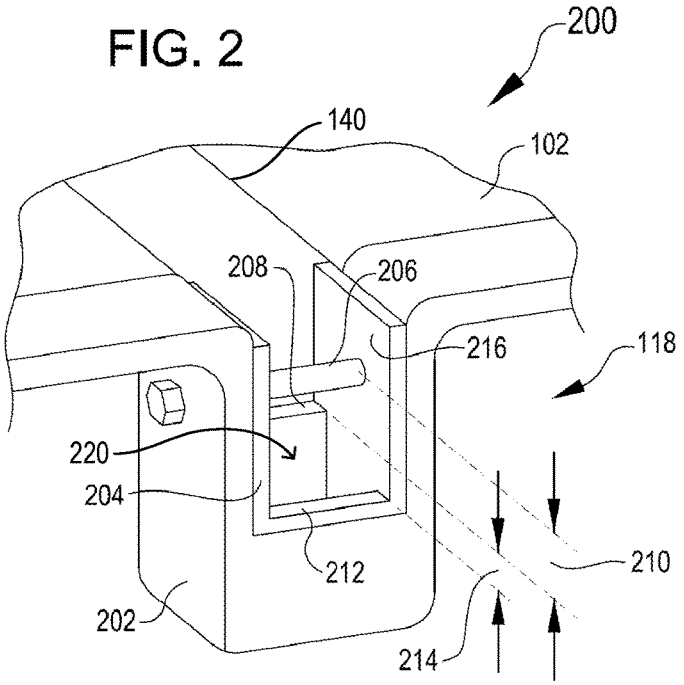
FIG. 2 illustrates a pivoting retention assembly of the pallet shown in FIG. 1.

The transition of the retention rails 110*a*, 110*b* between stowed, upright, and open configurations can be facilitated by retention assemblies 118*a*, 118*b* (cumulatively 118). FIG. 2 shows an example of a pivot bracket 200 corresponding to a pivoting retention assembly 118 shown in FIG. 1, in accordance with embodiments.

Figure 3:
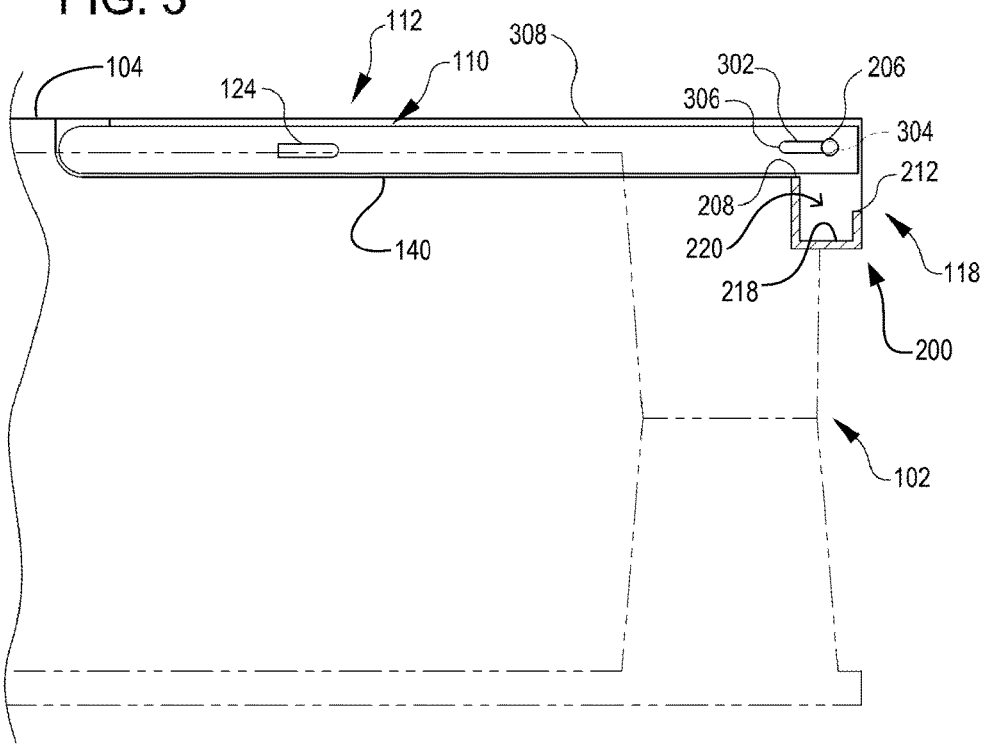
FIG. 3 illustrates aspects of the pivoting retention assembly of FIG. 2 in a stowed configuration.
Figure 4:
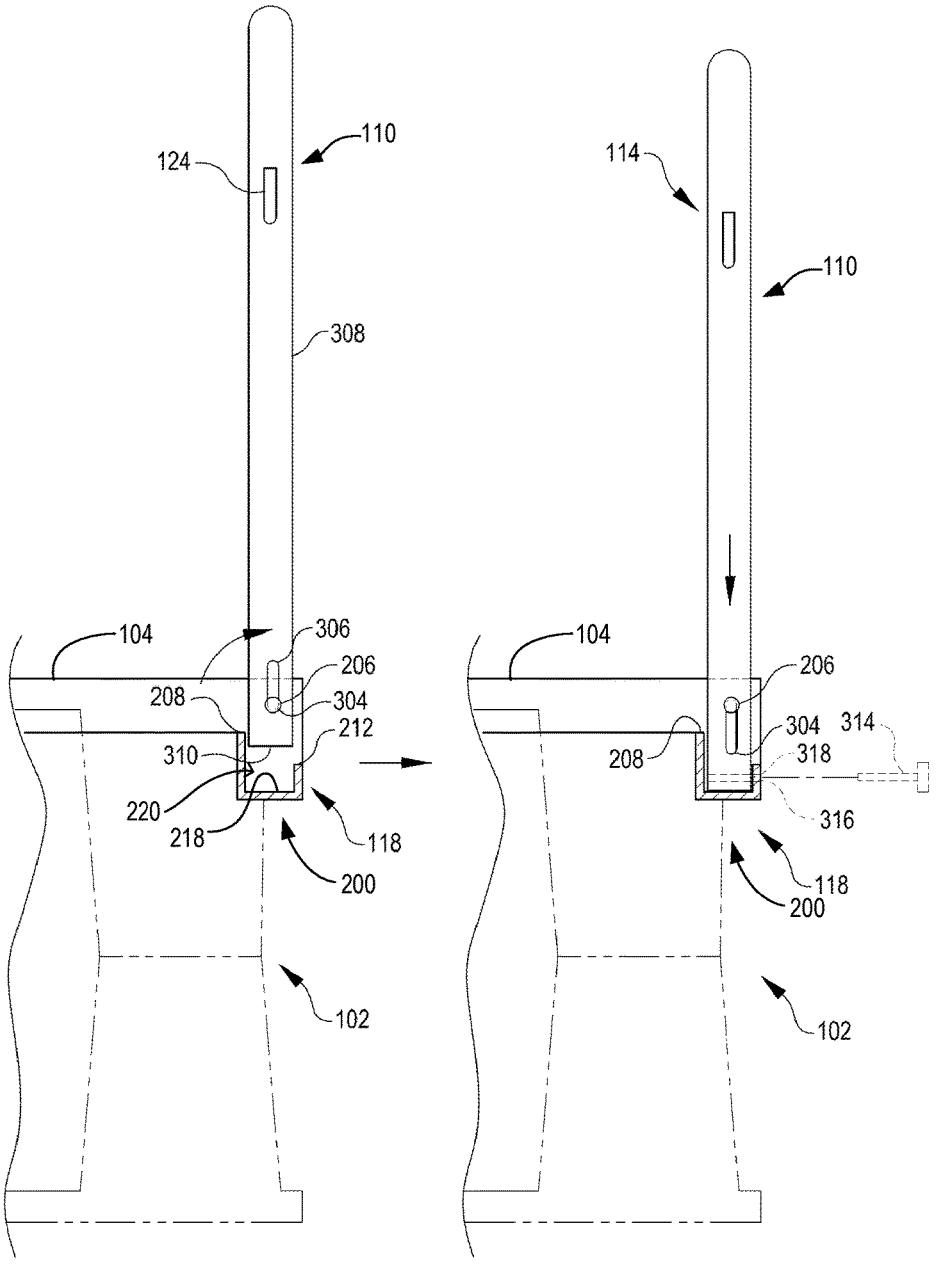
FIG. 4 illustrates aspects of the pivoting retention assembly of FIG. 2 in an upright configuration.
Figure 5:
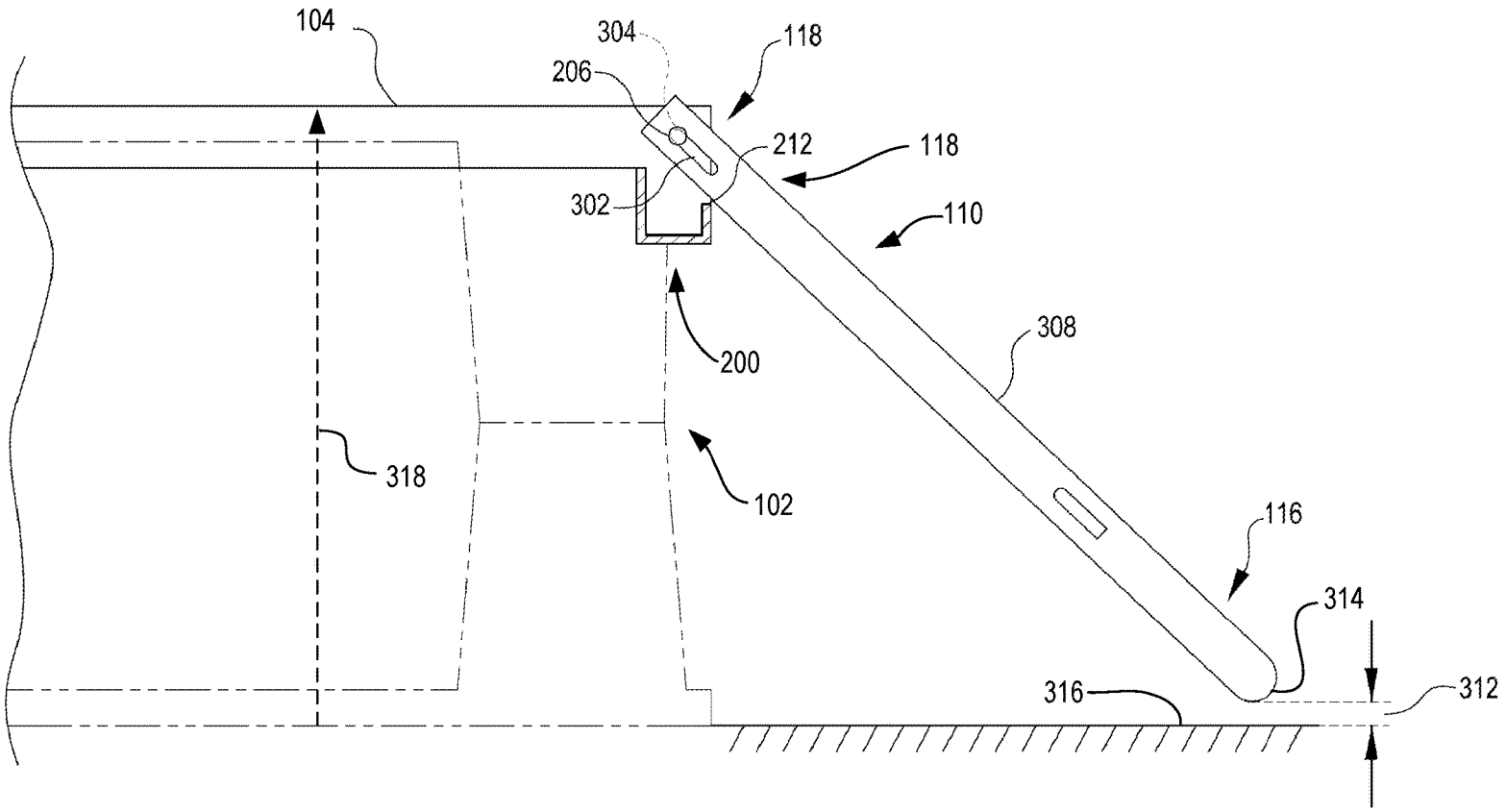
FIG. 5 illustrates aspects of the pivoting retention assembly of FIG. 2 in an open configuration.

The pivot bracket 200 includes an insert 204 received in a bracket receiving element 202 of the pallet body 102. The insert 204 is preferably aligned with a void 140 for receiving a retention rail. The insert 204 has a sidewall 216 that supports a pivot element 206, which can include a pin, bolt, or any other suitable element for pivotally supporting a retention rail (such as, e.g., retention rails 110*a*, 110*b* shown in FIG. 1). The insert 204 has a pallet-side edge 208 forming an inner opening positioned on a side of the insert proximate the pallet body 102. The pallet-side edge 208 has a pallet-side clearance 210 sufficient to allow a retention rail to lay flat toward the pallet body 102 without being obstructed by the pallet-side edge. The insert 204 also has an outside edge 212 forming an outside opening positioned distal from the pallet body 102. The outside edge may have an additional, outside clearance 214 extending lower than the pallet-side clearance height 210, the outside clearance being sufficient to allow a retention rail to extend outward and below horizontal when folded away from the pallet body 102. The bracket 200, specifically the bracket insert 204, defines a substantially hollow elongate body including a void 220 sized to receive a portion of a retention rail, such as retention rail such as retention rails 110*a*, 110*b* (FIG. 1). Specific configurations of a retention rail 110 installed in the pivot bracket 200 are shown in FIGS. 3-5, in accordance with embodiments. Having different parts defining the insert 204 and body 102 may be advantageous when the material of the pallet body and insert differ, e.g., insert 204 may be a strong metal while the pallet body 202 may be a lightweight material like polymer, wood, or composite. In alternative embodiments, features of the insert 204 and receiving element 202 can be combined or integrated as a single part.

FIG. 3 shows the stowed position 112 of a retention rail 110 installed in a pivot bracket 200 of a pivoting retention assembly 118, in a side schematic view, in accordance with embodiments. This stowed configuration 112 corresponds to the stowed position 112 of retention rails 110*a*, 110*b* as shown in FIG. 1. In the stowed configuration 112, the retention rail 110 is positioned in a void 140 in the upper support structure 104 of the pallet body 102. The retention rail 110 is pivotally connected with the pivot bracket 200. The retention rail 110 includes an elongate portion 308 (shown laid horizontally) and an elongate through-hole 302 positioned therein, the through-hole 302 having an upper end 306 and a lower end 304. The pivot element 206 passes through the through-hole 302, and the elongate portion 308 of the retention rail 110 rests on or above the pallet-side edge 208 of the pivot bracket 200.

In some embodiments, retention rail 110 and/or retention elements 124 may interact with the void 140 when in the stowed configuration 112, e.g. by mechanical interference, to retain the retention rail in the void. In some cases, further retention features, such as straps or pins, may be added to the void 140 to retain the retention rail 110.

FIG. 4 shows the upright position 114 of the retention rail 110 of FIG. 3, in accordance with embodiments. This upright position 114 shown here with reference to retention rail 110 corresponds to the upright position 114 of retention rails 110*a*, 110*b* as shown in FIG. 1. The retention rail 110 is elevated from the stowed position 112 (FIG. 3) by rotating the elongate portion 308 of the retention rail at the pivoting retention assembly 118. The retention rail 110 can be elevated upward from the upper support structure 104 of the pallet body 102 until the elongate portion 308 is perpendicular to the upper support structure and positioned above and aligned with the void 220 in the bracket 200. Here, the bracket 200 and retention rail 110 cooperate to form a locking mechanism that secures the retention rail in the upright position 114. When the retention rail 110 is positioned vertically, the elongate portion 308 can be moved downward into the void 220 of the substantially hollow elongate body of the bracket 200 to engage the locking mechanism. The elongate hole 302 in the retention rail 110 can be moved along the pivot element 206 until the top end 306 of the hole contacts the pivot element 206. The base 310 of the retention rail 110 can contact an inner surface 218 of the bracket 200 in order to support and secure the retention rail in the upright position 114. Thus, the retention rail 110 is secured in the bracket 200 when the base 310 is positioned below the pallet-side edge 208 and the outside edge 212 of the bracket. According to some embodiments, the retention rail 110 may be secured in position by its own weight and/or by friction with the bracket 200. According to some alternative embodiments, a retaining pin (e.g., optional retaining pin 314) or comparable part may be used to secure the retention rail 110 in the upright position 114. For example, retaining pin 314 may be inserted into the bracket 200 and retention rail 110 via respective retention holes 316, 318 therein, in order to prevent the retention rail 110 from being inadvertently removed from the bracket 200.

FIG. 5 shows the open position 116 of the retention rail 110 of FIGS. 3 and 4, in accordance with embodiments. This open position 116 corresponds to the open position 116 of retention rails 110*a*, 110*b* as shown in FIG. 1. The retention rail 110 can be moved to the open position 116 by rotating the elongate portion 308 of the retention rail at the pivoting retention assembly 118. If the retention rail 110 is moved from the upright position 114 (FIG. 2), it may first be necessary to lift the retention rail to clear the bracket 200, e.g. by lifting the elongate portion 308 of the retention rail until the bottom end 304 of the elongate through-hole 302 is in contact with the pivot element 206. The retention rail 110 can then be rotated outward, away from the upper support structure 104 of the pallet body 102. According to some embodiments, the outside edge 212 of the bracket 200 can mechanically interfere with the elongate portion 308 to limit the range of motion of the retention rail in the open position 116. For example, the outside edge 212 can be positioned to create a clearance distance 312 between a top end 314 of the retention rail 110 and a surface 316 underneath the pallet body 102. The clearance distance 312 can vary between a minimal distance (e.g. 1-2 cm) sufficient to prevent impact with the surface 316, and a larger distance (e.g., up to a height 318 of the upper support structure 104). In some alternative embodiments, the top end 314 of the retention rail 110 may be permitted to contact the surface 316.

The retention rail 110 shown in FIGS. 3-5 is operable to both rotate about the pivot element 206 and to lock in place in the bracket 200 by sliding along the pivot element by way of the elongate hole 302. In alternative embodiments, retention rails may be pivotally connected with retention assemblies by other means. For example, FIGS. 6 and 7 illustrate alternative retention assemblies, in accordance with embodiments.

Figure 6:
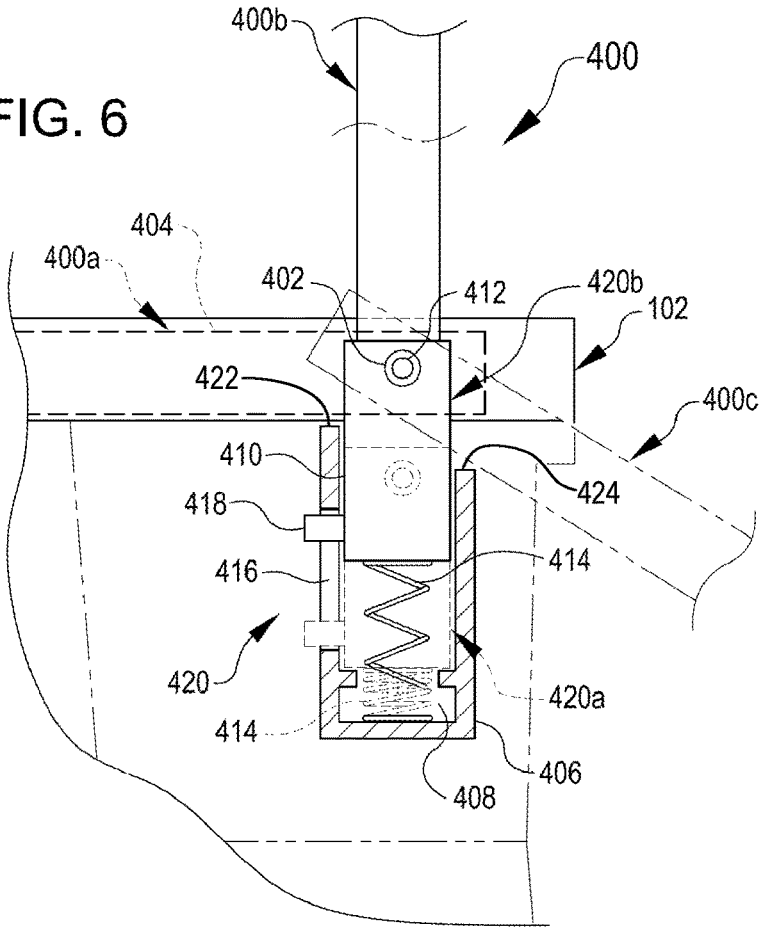
FIG. 6 illustrates a first alternative embodiment of a pivoting retention assembly for a pallet.
Figure 7:
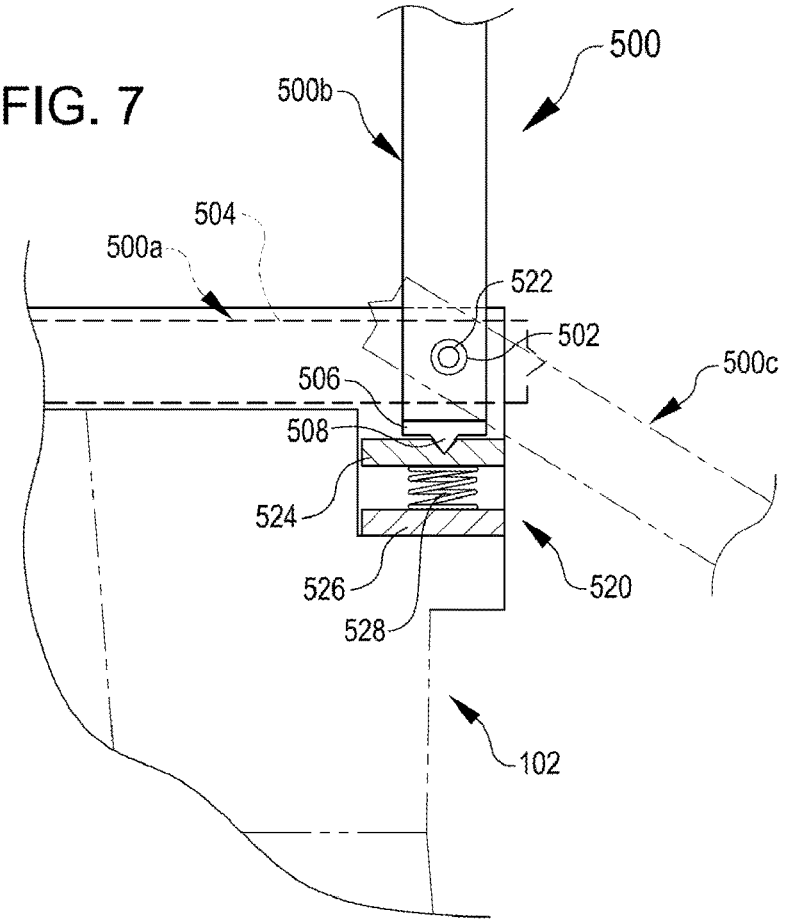
FIG. 7 illustrates a second alternative embodiment of a pivoting retention assembly for a pallet.

FIG. 6 shows an alternative retention assembly 400 including a retention rail 404 installed in a pivot bracket 420 of pallet 102, in a side schematic view, in accordance with embodiments. The retention rail 404 is shown in a stowed position 400*a*, an upright position 400*b*, and an open position 400*c*, analogous to the stowed, upright, and open positions 112, 114, 116 described above for retention rail 110 of FIGS. 3-5. The retention rail 404 is pivotally connected with a slider 410 by way of a through-hole 402 and a pivot element 412 connected with the slider, and the slider 410 slidingly fits within a bracket insert 406.

The slider 410 has a lower position 420*a* and an upper position 420*b*. When the slider 410 is in the upper position 420*b*, the retention rail 404 is free to move between the stowed position 400*a*, the upright position 400*b*, and the open position 400*c*. In the stowed position 400*a*, the retention rail 404 can rest on top of or above a pallet-side edge 422 of the bracket insert 406. Similarly, in the open position 400*c*, the retention rail 404 can rest on top of or above an outside edge 424 of the bracket insert 406. The positioning of the pallet-side and outside edges 422, 424 with respect to the pivot element 412 is similar to the positioning of the pallet-side and outside edges 208, 212 with respect to pivot element 206 as shown in FIGS. 2-5.

When the retention rail 404 is in an upright position 400*b*, the slider 410 and bracket insert 406 cooperate to form a locking mechanism to secure the retention rail 404 in the upright position 400*b*. The slider 410 can be moved into the lower position 420*a* which secures the retention rail 404 within the bracket 406 to engage the locking mechanism. In some embodiments, travel of the slider 410 within the bracket 406 can be limited. For example, a pin 418 within a groove or elongate hole 416, or similar mechanical means, may be used to prevent the slider 410 from exiting the bracket 406. In some embodiments, a spring element 414 can be provided in an interior 408 of the bracket 406 for biasing the slider 410 toward the lower position 420*a*; or alternatively, for biasing the slider toward the upper position 420*b*.

Retention assemblies 118 and 400 described above with reference to FIGS. 3-6 provide locking mechanisms for rigid upright locking of the retention rails 110, 404, respectively. However, in some alternative embodiments, it is advantageous for retention rails to be secured upright by way of elastic means which permit retention rails to collapse under load.

FIG. 7 shows another alternative retention assembly 500 including a retention rail 504 attached with a pivot element 522 above a recess 520 of a pallet 102, in a side schematic view, in accordance with embodiments. The retention rail 504 is shown in a stowed position 500*a*, an upright position 500*b*, and an open position 500*c*, analogous to the stowed, upright, and open positions 112, 114, 116 described above for retention rail 110 of FIGS. 3-5, and analogous to the stowed, upright, and open positions 400*a-c* described above with reference to FIG. 6. The retention rail 504 is pivotally connected with the recess 520 by way of a through-hole 502 pivotally connected with the pivot element 522.

In operation, the retention rail 504 can be pivoted by a user from the stowed position 500*a* and through the upright, and open positions 500*b*, 500*c* by causing a base end 506 of the retention rail to pass through the recess 520. The recess 520 can include a moving element 524 elastically coupled with a base 526 of the recess, e.g. by a spring 528 or any suitable elastic element. The base 506 of the retention rail 504 can displace the moving element 524 as the retention rail is moved through the upright position 500*b*. The moving element 524 of the recess 520 can also be shaped to interact with a base 506 of the retention rail 504 in order to lock the retention rail in the upright position 500*b*. In some cases, the base 506 can include locking features 508 shaped to interact with the moving element 524 of the recess 520. In combination, the locking features 508 and a stiffness of the spring 528 cause the retention rail 504 to be stable in the upright position 500*b* until acted on by a suitably strong outside force.

The various embodiments of retention assemblies described above with reference to FIGS. 2-7 enable a retention rail of a pallet retention system to pivot between an open position, a locked upright position, and a stowed position. These configurations allow for greater flexibility in pallet loading, while providing for built-in features for the secure retention of items. Suitable, non-limiting examples of loading configurations enabled by these configurations are provided below with reference to FIGS. 8 and 9.

Figure 8:
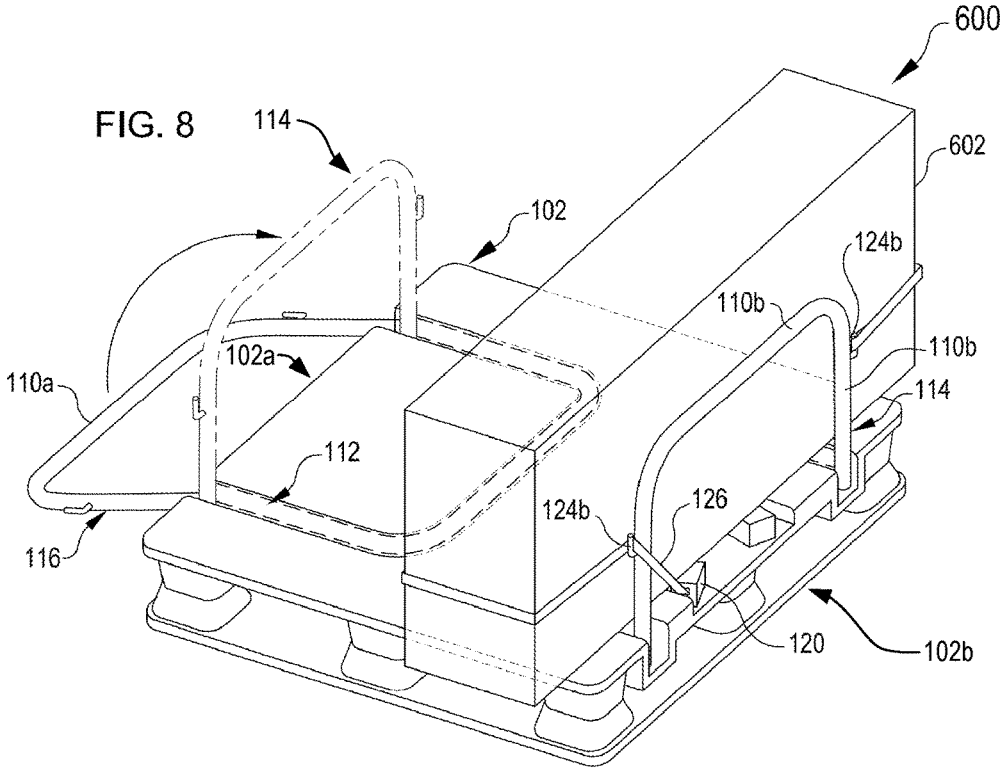
FIG. 8 illustrates the pallet and pivoting retention assemblies of FIG. 1 in a first loading configuration.

FIG. 8 shows a first, asymmetric loading configuration 600 of the pallet 102 shown in FIG. 1, in accordance with embodiments. In the asymmetric loading configuration 600, an item 602 can be loaded on the pallet 102 over the first side 102*a* and set adjacent to a retaining rail 110*b* at the second side 102*b*. A first retaining rail 110*a* can be positioned in an open configuration 116 during the loading process to prevent the first retaining rail from obstructing the item 602 or equipment used in moving the item. The second retaining rail 110*b* is positioned in an upright position 114 in order to provide for secure placement of the item 602.

Once the item 602 is positioned against the second retaining rail 110*b*, the item 602 can be secured to the second retaining rail 110*b*, e.g., via a retaining strap 126. According to some embodiments, the retaining strap can originate at a strap source element 120, and can be secured around the item 602 by way of strap receiving elements 124*b*. After loading, the first retention rail 110*a* can be raised to an upright position 114 and locked in place. Alternatively, the first retention rail 110*a* can be stowed in a stowed position 112. In some cases, the first retention rail 110*a* may be placed in a stowed position 112 prior to loading the pallet 102.

Figure 9:
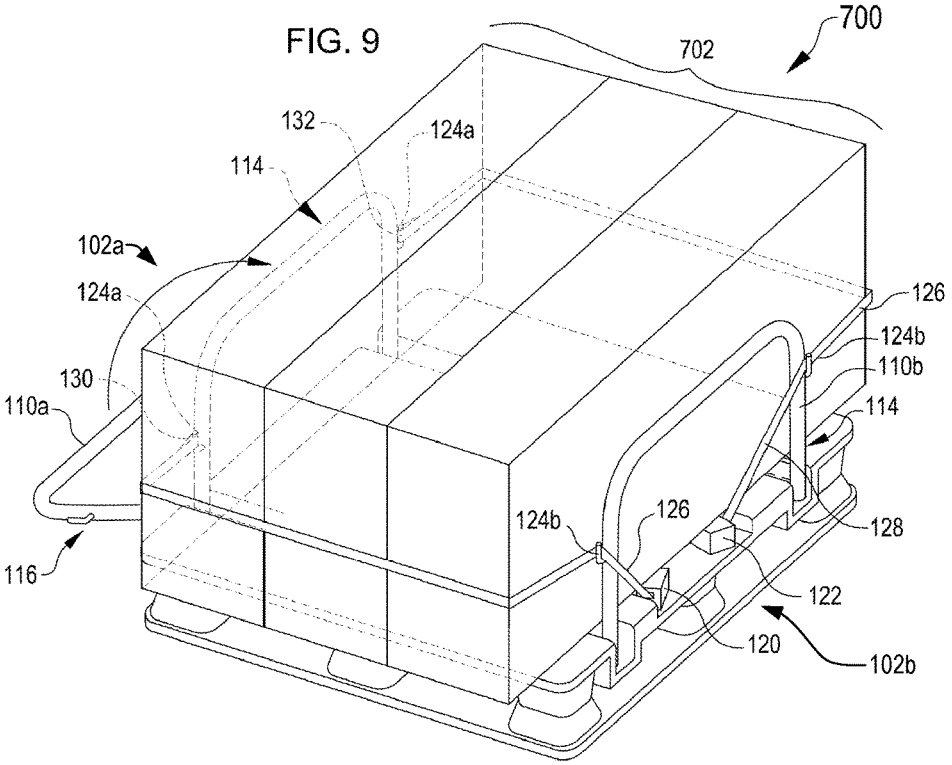
FIG. 9 illustrates the pallet and pivoting retention assembly of FIG. 1 in a second loading configuration.

FIG. 9 shows a second, symmetrical loading configuration 700 of the pallet 102 shown in FIG. 1, in accordance with embodiments. In the symmetrical loading configuration 700, a group of items 702 can be loaded on the pallet 102 over the first side 102*a* and set adjacent to the retaining rail 110*b* on the second side 102*b* of the pallet. The first retaining rail 110*a* can be positioned in an open configuration 112 during the loading process in order to prevent the first retaining rail 110*a* from obstructing the items 702 or any loading equipment or personnel during loading. The second retaining rail 110*b* is positioned in an upright position 114 in order to provide for secure placement of the items 702. Once the items 702 are placed on the pallet 102, the first retaining rail 110*a* can be rotated to the upright position 114 in order to further secure the items 702.

The items 702 can be further secured to the pallet 102 by way of retaining straps 126, 128. The retaining straps 126, 128 can originate from strap source elements 120, 122, and can be looped through strap receiving elements 124*b* on the second retention rails 110*b* and connected with strap receiving elements 124*a* on the first retention rails by strap end loops 130, 132, so that the straps 126, 128 fully enclose the items 702 in combination with the first and second retention rails 110*a*, 110*b*. Although both FIGS. 8 and 9 show the first retention rail 110*a* in the open position 116, it will be understood that a loading or unloading operation can be enabled by collapsing either or both of the first and second retention rails 110*a*, 110*b* to the open position.

It will be understood that various components of the systems and assemblies described above may be combined or omitted without deviating from the spirit of the disclosure. For example, various retention features and components of the disclosed retention assemblies may be combined unless clearly contraindicated.

The specification and drawings are to be regarded in an illustrative rather than a restrictive sense. It will, however, be evident that various modifications and changes may be made thereunto without departing from the broader spirit and scope of the disclosure as set forth in the claims.

Other variations are within the spirit of the present disclosure. Thus, while the disclosed techniques are susceptible to various modifications and alternative constructions, certain illustrated embodiments thereof are shown in the drawings and have been described above in detail. It should be understood, however, that there is no intention to limit the disclosure to the specific form or forms disclosed, but on the contrary, the intention is to cover all modifications, alternative constructions, and equivalents falling within the spirit and scope of the disclosure, as defined in the appended claims.

The use of the terms "a" and "an" and "the" and similar referents in the context of describing the disclosed embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the disclosure and does not pose a limitation on the scope of the disclosure unless otherwise claimed. No language in the specification should be construed as indicating any non-claimed element as essential to the practice of the disclosure.

Disjunctive language such as the phrase "at least one of X, Y, or Z," unless specifically stated otherwise, is intended to be understood within the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. A pallet, comprising:

a support structure, the support structure having a top surface, a bottom surface, a front face, and a rear face, the bottom surface spaced from and opposite the top surface in a first direction, and the rear face being spaced from and opposite the front face in a second direction, the second direction being perpendicular to the first direction;

a first recess in the support structure at a first intersection of the front face and top surface, the first recess having a first opening defined by the top surface and a second opening defined by the front face, the recess extending from the top surface in the first direction and from the front face in the second direction;

a second recess in the support structure at a second intersection of the top surface and the rear face, the second recess having a third opening defined by the top surface and a fourth opening defined by the rear face, the recess extending from the top surface in the first direction and from the rear face in a third direction, the third direction being opposite of the second direction;

a first rail pivotably coupled to the support structure within the first recess; and a second rail pivotably coupled to the support structure within the second recess, the first rail, the second rail, and the support structure being configured such that the first rail and the second rail are each pivotable about respective first and second pivot axes between a stowed configuration, an upright configuration, and an open configuration such that, in the open configuration, the first rail extends through the second opening and the second rail extends through the fourth opening, and such that the first and second rails are each fully disposed beneath the top surface of the pallet in the stowed configuration.

2. The pallet of claim 1, further comprising:

a first bracket attached to the support structure, the first bracket having a first body that defines a first void that is configured to receive a bottom end of the first rail when the first rail is in the upright configuration; and a second bracket attached to the support structure, the second bracket having a second body that defines a second void that is configured to receive a bottom end of the second rail when the second rail is in the upright configuration.

3. The pallet of claim 1, further comprising:

a retractable strap assembly mounted to the support structure, the retractable strap assembly including a retractable strap; and a plurality of strap receiving elements disposed on the first and second rails, each strap receiving element of the plurality of strap receiving elements configured to receive the retractable strap.

4. The pallet of claim 1, wherein the front face of the support structure defines a first outside edge and the rear face of the support structure defines a second outside edge, the first outside edge and the second outside edge being configured to mechanically prevent the first rail and the second rail from extending below the bottom surface of the pallet body.

5. The pallet of claim 1, wherein the first recess and the second recess are each configured such that when the first rail and the second rail are in the stowed position, the first rail and the second rail are flush with the top surface of the support structure.

6. The pallet of claim 1, wherein the first rail and the second rail each comprise a U-shaped member.

7. The pallet of claim 6, wherein the first and second rails do not overlap when the first and second rails are in the stowed position.

8. A pallet, comprising:

a rail; and a support structure comprising a top surface and a front face orthogonal to the top surface, wherein the rail is pivotably connected to the rail about a pivot axis with the support structure about a pivot axis within a recess in the support structure positioned at an intersection between the front face and top surface, wherein the support structure and rail are configured such that the rail is pivotable while connected with the support structure within the recess between a stowed configuration, an upright configuration, and an open configuration, the stowed configuration being more than 90 degrees from open configuration as measured about the pivot axis, and wherein an entire length of the rail is disposed within the recess in the stowed configuration.

9. The pallet of claim 8, wherein the rail has a body that defines an elongate hole and the rail is pivotably and slidably connected to the pivot axis via the elongate hole, and the pallet further comprises a bracket attached to the support structure, the bracket having a body that defines a void that is configured to receive a bottom end of the rail when the rail is in the upright configuration.

10. The pallet of claim 8, further comprising:

a sliding element pivotably connected to a bottom end of the rail via the pivot axis; and a bracket attached to the support structure, the bracket having a body that defines a void that is configured to slidably receive the sliding element when the rail is in the upright configuration.

11. The pallet of claim 8, wherein the rail has a body that defines an elongate hole and the rail is pivotably connected to the pivot axis via the elongate hole, the rail further comprising a base that includes a flange that extends downward when the rail is in the upright configuration, the support structure defines a recess in which the base is disposed when the rail is in the upright configuration, and the pallet further comprises a body slidably disposed within the recess, the body being biased upward by an elastic element when the rail is in the stowed configuration, and the body defining a second recess configured to fit the flange when the rail is in the upright configuration.

12. The pallet of claim 8, wherein the support structure defines an outside edge disposed below the pivot axis, and the outside edge is configured to mechanically prevent the rail from extending below a bottom surface of the pallet when the rail is in the open position.

13. The pallet of claim 12, wherein the outside edge is configured to mechanically support the rail between a first level of a top surface of the pallet and a second level of the bottom surface of the pallet when the rail is in the open position.

14. The pallet of claim 8, further comprising:

a retractable strap assembly mounted to the support structure, the retractable strap assembly including a retractable strap; and at least one strap receiving element disposed on the rail, the at least one strap receiving element configured to receive the retractable strap.

15. The pallet of claim 8, wherein the stowed configuration is more than 180 degrees from the open configuration as measured about the pivot axis.

16. A method of loading a pallet, the pallet comprising a rail and a support structure pivotably connected to the rail about a pivot axis within a recess of the support structure positioned at an intersection between a front face and a top surface of the support structure, the support structure and rail configured such that the rail is pivotable between a stowed configuration wherein an entire length of the rail is disposed in the recess below the top surface to an upright configuration, and an open configuration, the method comprising:

pivoting the rail about the pivot axis from the stowed configuration the open configuration, the pivoting step including rotating the rail more than 90 degrees about the pivot axis;

loading at least one item onto the pallet; and pivoting the rail about the pivot axis from the open configuration to the upright configuration.

17. The method of claim 16, wherein the step of pivoting the rail about the pivot axis from the open configuration to the upright configuration includes sliding the rail downward in relation to the pivot axis.

18. The method of claim 16 wherein the pallet further comprises a retractable strap assembly mounted to the support structure, the retractable strap assembly including a retractable strap and at least one strap receiving element disposed on the rail, the method further comprising a step of:

disposing the retractable strap about the item and into the at least one strap receiving element.

19. The method of claim 16 wherein the step of pivoting the rail about the pivot axis from the stowed configuration to the open configuration includes rotating the rail more than 180 degrees about the pivot axis.

20. The method of claim 16, wherein:

the support structure further comprises a recess; and the rail is slidingly connected with the support structure above the recess, the method further comprising a step of:

securing the rail in the upright configuration by sliding an end of the rail into the recess when the rail is in the upright configuration.

* * * * *